United States Patent [19]

Quigg et al.

[11] 4,227,323

[45] Oct. 14, 1980

[54] HYDRAULIC DREDGE SUCTION DIVERSION FLAP

[75] Inventors: Thomas O. Quigg, Hoquiam; Robert E. Delegard, Montesano, both of Wash.

[73] Assignee: Twin Harbor Dredging Co., Aberdeen, Wash.

[21] Appl. No.: 871,106

[22] Filed: Jan. 20, 1978

[51] Int. Cl.[3] ..... E02F 3/92

[52] U.S. Cl. ..... 37/58; 37/71; 37/DIG. 19

[58] Field of Search ..... 37/58, DIG. 19, 195, 37/71

[56] References Cited

U.S. PATENT DOCUMENTS

| | | | |
|---|---|---|---|
| 548,242 | 10/1895 | Wood et al. | 37/58 |
| 927,690 | 7/1909 | Singleton | 37/58 |
| 2,205,490 | 6/1940 | Peterson | 37/DIG. 19 |
| 3,600,832 | 8/1971 | Smith | 37/58 |
| 3,748,760 | 7/1973 | Schnell | 37/58 |
| 3,774,323 | 11/1973 | Vaughn | 37/58 |
| 4,058,914 | 11/1977 | Kiss | 37/58 X |

*Primary Examiner*—Clifford D. Crowder
*Attorney, Agent, or Firm*—Robert W. Beach; Ward Brown

[57] ABSTRACT

A flap is provided for the suction head of a hydraulic dredge to divert the dredge suction force generally in the direction that the head is swung along the bottom of a body of water and to guide material into the mouth of the suction head. The suction head includes top and bottom projections or lips projecting outward beyond the sides of the head, and the flap is pivotally mounted between such lips for swinging about an upright axis. Control mechanism swings the flap between alternative positions in which it extends outward from one of the sides of the suction head and from the other of such sides, respectively. An indicator is provided so that the position of the flap can be determined easily by the dredge operator.

7 Claims, 5 Drawing Figures

9
18P
17P
17S
18S
16S
16P
1
12
11S
3
11P
19S
21S
19P
12
6
24
13
33
21P
8
10
10
20S
14
8
20P
5
34
22S
22P
23S
23P
4
32
31

9
18P
17P
16P
18S
17S
16S
2
11P
1
3
11S
19P
12
19S
24
21P
6
10
13
33
8
21S
8
10
20S
14
20P
5
22P
22S
23S
23P
4
32
31

HYDRAULIC DREDGE SUCTION DIVERSION FLAP

BACKGROUND OF THE INVENTION

1. Field of the Invention

The present invention relates to a flap for diverting the suction force of a hydraulic dredge and for guiding material into the dredge mouth.

2. Prior Art

Customarily, dredged material is sucked through the mouth of a hydraulic dredge suction head as such head is swung and advanced along the bottom of a body of water. Sometimes a rotating cutter head is provided adjacent to the dredge mouth to churn the material and facilitate its entry into the mouth. A problem with known hydraulic dredges is that only material close to the dredge mouth is sucked through it and no mechanism is provided to guide material toward the dredge mouth. Consequently, each time the dredge suction head is swung along the bottom of the body of water only a narrow strip of material is dredged. It is necessary to advance the suction head slowly and to reposition it frequently to assure that the dredge mouth passes sufficiently close to each portion of an area to be dredged to remove the material to a uniform depth.

SUMMARY OF THE INVENTION

The principal object of the present invention is to provide an improvement for a hydraulic dredge enabling a wide strip of material to be dredged each time the dredge suction head is swung along the bottom of a body of water.

In accordance with the principal object, it is an object to provide an improvement for a hydraulic dredge for directing the dredge suction force in alternative lateral directions and for guiding material into the dredge mouth.

It is also an object to provide such improvement in a form which is of sturdy, simple and inexpensive construction and which may be incorporated easily into conventional hydraulic dredges.

The foregoing objects can be accomplished by providing a swingable diversion flap for the suction head of a hydraulic dredge. In the preferred embodiment of the invention, a pivot mounts such flap between top and bottom suction head projections or lips projecting outward beyond the sides of the head for swinging of the flap about an upright axis. Flap portions extend directly opposite from the pivot and the inward extending portion of the flap is substantially longer than the outward extending portion of the flap. Mechanism is operable to swing the flap from a position angled outward from one side of the suction head to a position angled outward from the other side of such head. Indicator mechanism enables the position of the flap relative to the head to be determined easily by the operator of the dredge.

DETAILED DESCRIPTION

Figure 1:
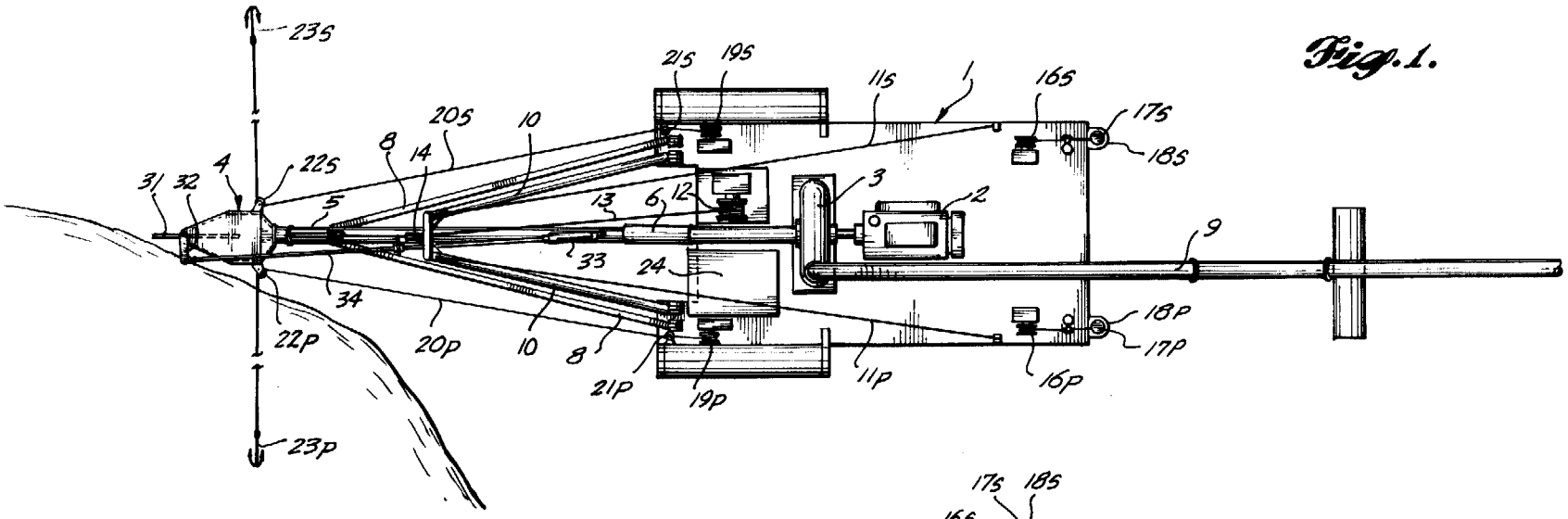
FIG. 1 is a somewhat diagrammatic top plan of a hydraulic dredge having a diversion flap in accordance with the present invention.

The improvement of the present invention can be incorporated into any known type of hydraulic dredge, including swinging-dredge type hydraulic dredges, swinging-ladder type hydraulic dredges, and hopper dredges. In the representative swinging-dredge type hydraulic dredge shown in FIGS. 1, 2 and 3, a barge 1 carries an engine 2 for driving a centrifugal pump 3. The pump inlet communicates with the dredge suction head 4 by a forward projecting inlet pipe including an outer rigid portion 5 connected to the suction head, an intermediate flexible portion 6 and an inner rigid portion 7. Outer inlet pipe portion 5 is carried by a ladder 8 pivotally connected to the barge bow for elevational swinging. Such ladder supports the inlet pipe against lateral movement relative to the barge. The pump outlet is connected to a discharge pipe 9 which may extend to shore, to a scow or to any other area where it is desired to dump material sucked through the mouth of the dredge suction head by the centrifugal pump.

A boom 10 is maintained in forward and upward projecting position by starboard and port guys 11*s* and 11*p*, respectively. A central bow winch 12 drives a hoisting line 13 extending over a boom sheave 14 and through tackle 15 to the inlet pipe outer portion 5. Hauling in and paying out of hoisting line 13 by boom winch 12 effects elevational swinging of inlet pipe portion 5 about the flexible portion 6 and elevational movement of the dredge suction head 4.

Four other winches are carried by the barge. Starboard and port stern winches 16*s* and 16*p*, respectively, are provided to hoist or release upright anchoring spuds 17*s* and 17*p* mounted for vertical lengthwise sliding in aftward extending brackets 18*s* and 18*p*. Side bow winches 19*s* and 19*p* drive lateral control lines 20*s* and 20*p*. Each control line extends forward from a winch drum through a guide pulley 21*s* or 21*p* carried at a side of the barge bow, then through a guide pulley 22*s* or 22*p* mounted on a side of the dredge suction head, and finally generally laterally of the barge to an anchor 23*s* or 23*p*. All of the barge winches are controlled by an operator in a cabin 24.

The operation of the representative dredge shown in the drawings is as follows: barge 1 is moved into position adjacent to an area to be dredged with discharge hose 9 extending to a dumping location. Spuds 17*s* and 17*p* are released to slide downward through brackets 18*s* and 18*p* so that their lower pointed tips pierce the bottom to anchor the barge. Anchors 23*s* and 23*p* are set a substantial distance to starboard and port, respectively. Then hoisting line 13 is paid out to lower the dredge suction head to the bottom and engine 2 driving pump 3 is started.

Lateral swinging of the barge and the dredge suction head 4 is effected by hoisting one spud, for example spud 17*s*, and then hauling in the control line at the opposite side of the barge, for example control line 20*p*, while correspondingly paying out the other control line, for example control line 20*s*. This effects lateral swinging of the entire dredge about the other spud, for example about spud 17*p*. In the example the dredge would be swung from the position shown in FIG. 1 to the position shown in FIG. 2. At the end of one lateral sweep, the hoisted spud is released, the other spud is hoisted and the corresponding hauling in and paying out of the control lines is reversed to swing the dredge in the opposite direction about the newly anchored spud. Consequently, the dredge swings from side to side and is advanced as it walks forward on its spuds. The speed of advancement of the dredge depends on the distance between the spuds and on the angle of swing of the dredge.

Figure 4:
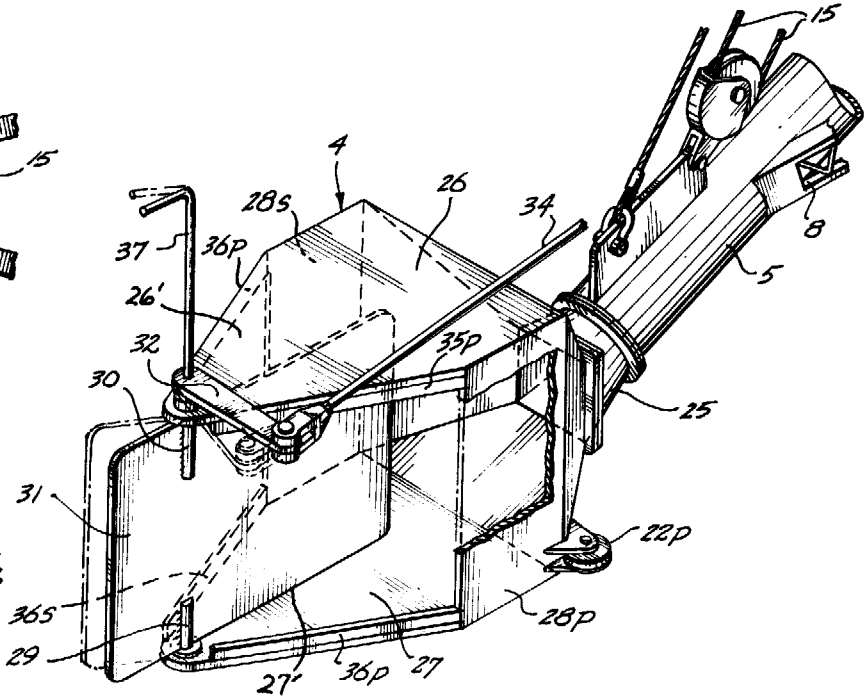
FIG. 4 is a fragmentary top perspective showing the suction head of the dredge of FIG. 1 with part of such head broken away.
Figure 5:
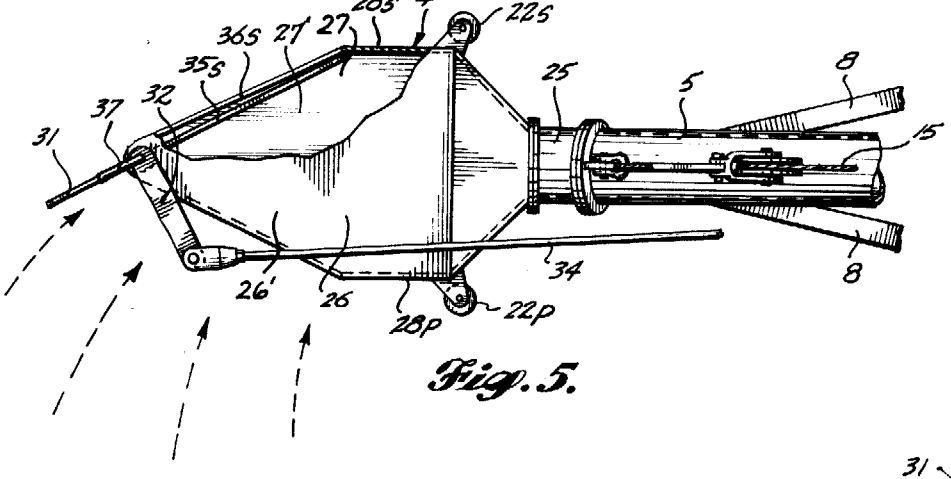
FIG. 5 is a fragmentary top plan showing the suction head of the dredge of FIG. 1 with part of such head broken away.

As best seen in FIGS. 4 and 5, in a dredge improved in accordance with the present invention, a transition piece 25 connects the outer end of inlet pipe 5 with the dredge suction head 4. Such head is symmetrical about a vertical plane bisecting the adjacent inlet pipe portion 5 and has a top, bottom and sides 26, 27 and 28*s* and 28*p*, respectively. The head top and bottom include respective generally triangular forward projections or lips 26' and 27' projecting outward beyond the head sides 28*s* and 28*p*. Coaxial stub shafts 29 and 30 are journaled in the tip portions of the bottom and top lips, respectively. Such shafts carry a planar diversion flap 31 of rigid plate material between the suction head lips for swinging about an upright hinge axis located in the plane of symmetry of the suction head and extending between the planes of the head sides 28*s* and 28*p*.

Figure 2:
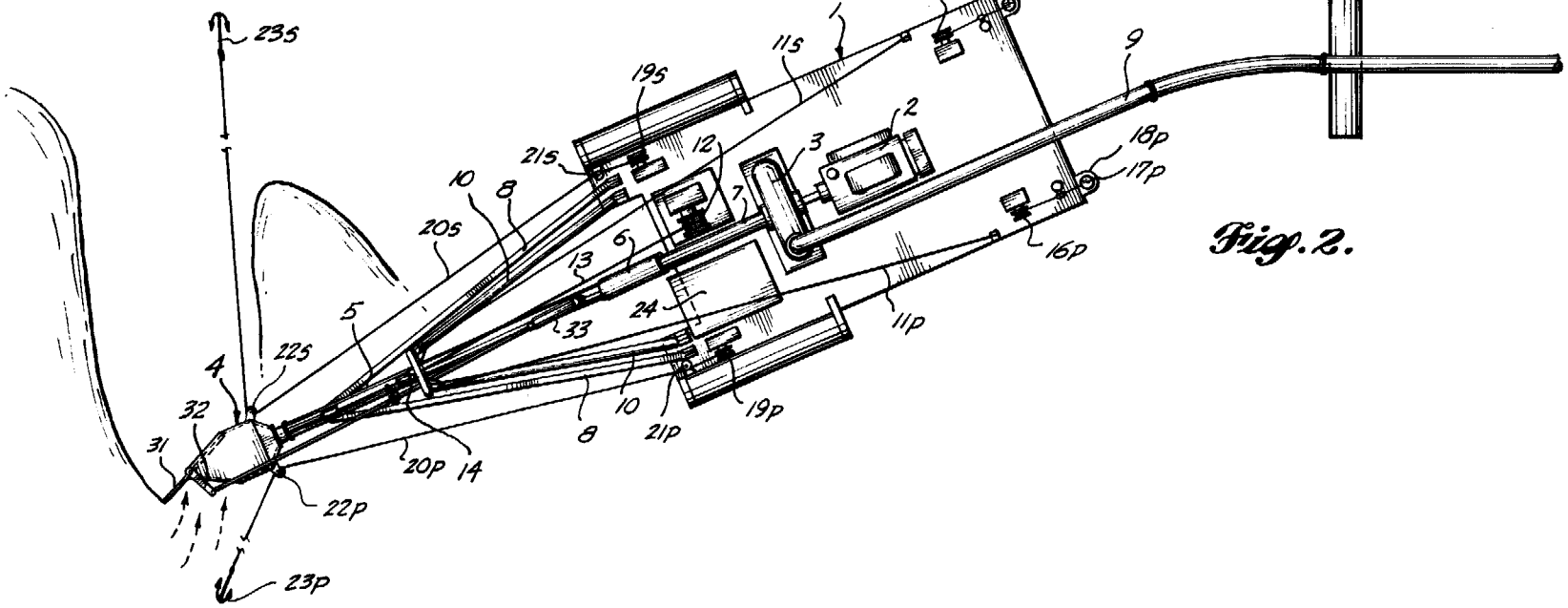
FIG. 2 is a view corresponding to FIG. 1, the dredge having been swung to port.
Figure 3:
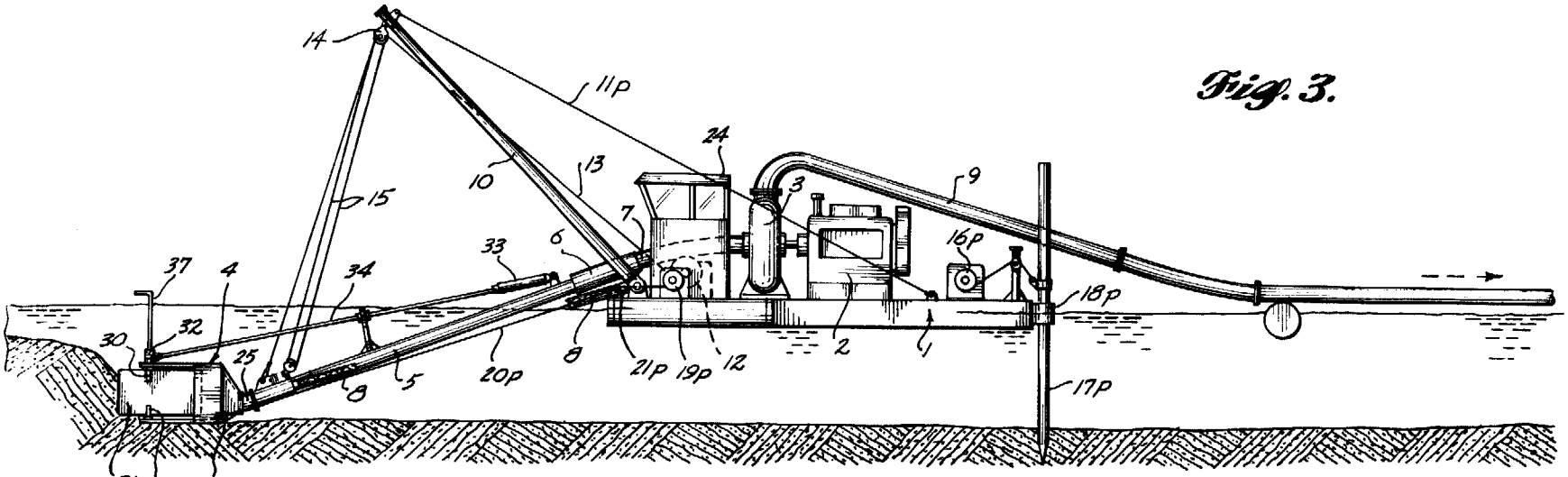
FIG. 3 is a somewhat diagrammatic side elevation of the dredge of FIG. 1.

To swing the diversion flap relative to the suction head, or to hold the flap in a selected swung position, a control lever 32 has one of its ends connected to upper stub shaft 30 above lip 26'. As shown in FIGS. 1, 2 and 3, the other end of the control lever is connected to the plunger of a double-acting hydraulic or pneumatic cylinder 33 by a tie rod 34. It is desirable to mount cylinder 33 toward the inner end of inlet pipe portion 5 so that such cylinder is always out of the water.

Diversion flap 31 extends into the dredge suction head a sufficient distance, and is swingable by cylinder 33 through a sufficient angle, that the flap may be swung between extreme positions in which it projects outward from and at an angle to one or the other of the head sides 28*s* or 28*p*. For example, in FIG. 5 flap 31 is shown in its extreme starboard position extending from the starboard head side 28*s*. In such position, the inner portion of flap 31 extending inward from shafts 29 and 30 rests against respective upper and lower sealing and stop flanges 35*s* and 36*s* so that the flap forms an angled continuation of suction head side 28*s*. The port side of the suction head has corresponding flanges 35*p* and 36*p*. The outer portion of flap 31 extends outward past shafts 29 and 30 a short distance.

An indicator rod 37 extends upward from upper stub shaft 30 and the inner end of control lever 32. The upper end portion of such rod is bent forward in the direction the outer portion of flap 31 projects outward from the suction head. Such indicator rod is of sufficient length that its forward bent upper end portion is always above the water surface so that the dredge operator can determine the position of flap 31 relative to the suction head easily.

In a typical installation, inlet or suction pipe 5 can be twelve inches in diameter and dredge mouth 4 can be about three feet high and two and one-half feet wide. The suction head lips can project about two feet outward beyond the sides of the head. The diversion flap can be a metal plate one-half inch to one inch thick. Such flap can be mounted so that it extends about one foot outward beyond stub shafts 29 and 30.

When it is desired to swing the dredge to port, diversion flap 31 is swung counterclockwise as seen in plan to its extreme starboard position shown in FIGS. 2 and 5. As indicated in FIG. 5, in this position the entire sucking force of the dredge is directed through the open dredge mouth between the port sides of lips 26' and 27'. As the suction head is swung as described above, a wide strip of material generally lateral of the suction head and ahead of the open dredge mouth is sucked through it. A wide pocket is cut continuously ahead of the dredge mouth in the direction of swing by the section of flap 31 projecting outward beyond the hinge shafts 29 and 30, as indicated in FIG. 5. At least the outer end portion of flap 31 acts as a scoop for material a substantial distance outward of the dredge mouth. The scooped material is guided into the dredge mouth by the angled flap. Thus, a much wider strip of material is dredged in a single sweep of the dredge than is possible with conventional dredges not having a diversion flap in accordance with the present invention. The speed of swinging of the dredge is selected so as to effect entry of a desired proportion of material and water into the dredge mouth.

At the end of the dredge's port sweep, the spuds are adjusted as described earlier, the diversion flap is swung clockwise as seen in plan by reversing the fluid force in cylinder 33 from the extreme starboard position to the extreme port position of the flap and the dredge is swept to starboard by the control lines. Again, the entire suction force of the dredge is directed in the direction of swinging of the dredge, the diversion flap scoops material and guides it into the dredge mouth, and a wide strip of material is dredged. Consequently, the dredge can be swung through relatively large angles and is advanced faster and repositioned less frequently than a conventional dredge.

We claim:

1. In a dredge including a suction head swingable along the bottom of a body of water, such head having opposite sides and upper and lower lips between such sides forming an end-opening mouth therebetween through which material is sucked, the improvement comprising a suction pipe connected to such head remote from the head's end-opening mouth and the head being symmetrical about an upright plane bisecting the suction pipe connection, upright pivot means carried by the outer portions of said lips in the plane of symmetry of the head, an upright flap swingably mounted by said pivot means for swinging through the plane of symmetry of the suction head to alternative extreme positions at opposite sides, respectively, of said plane of symmetry, said flap having an inner portion and an outer portion at opposite sides of said pivot means, respectively, in coplanar relationship, said flap inner portion extending inward from said pivot means a distance sufficient for engagement with a selected one of the head sides to limit outward swinging of the inner portion of the flap and said flap outer portion projecting outward from said pivot means a distance less than the inward extension of said inner portion from said pivot means for scooping material to be sucked into the suction head mouth.

2. In the dredge defined in claim 1, the suction head upper and lower lips projecting outward beyond the head sides, and the pivot means being carried by the portions of said lips outward beyond such head sides.

3. In the dredge defined in claim 1, the head sides being located for limiting swinging of the flap means to an acute angle between its alternative extreme positions.

4. In the dredge defined in claim 1, a flange on one of the lips, said flange being positioned so that the flap rests against said flange when the flap is in one of its alternative extreme positions.

5. In a dredge including a suction head having a mouth through which material is sucked, means for swinging such head along the bottom of a body of water and flap means swingable relative to such head for scooping material and guiding it into the dredge mouth, the improvement comprising actuating means connected to the flap means separate from and independent of the head-swinging means for swinging the flap means relative to the suction head, and means separate from and independent of the head-swinging means and said actuating means for indicating the position of the flap means relative to the suction head, said indicating means projecting upward from the suction head independently of said actuating means and being connected to and swingable conjointly with the flap means relative to the suction head.

6. In the dredge defined in claim 5, the indicating means including an indicator rod extending upward from the flap means adjacent to the pivot means.

7. In a dredge including a suction head swingable along the bottom of a body of water, such head having a mouth through which material is sucked, flap means for scooping material and guiding such material into the dredge mouth and pivot means mounting the flap means adjacent to the suction head for swinging of the flap means relative to the suction head, the improvement comprising the pivot means mounting the flap means for swinging about an upright axis, and an indicator rod connected to the flap means, extending upward from the pivot means and rotatable conjointly with the flap means for indicating the position of the flap means relative to the suction head.

* * * * *